US011841723B2

(12) United States Patent
Li et al.

(10) Patent No.: US 11,841,723 B2
(45) Date of Patent: Dec. 12, 2023

(54) DISTRIBUTED LDO STRUCTURE WITHOUT EXTERNAL CAPACITOR

(71) Applicant: Shanghai Huali Integrated Circuit Corporation, Shanghai (CN)

(72) Inventors: Xiangyang Li, Shanghai (CN); Yifei Qian, Shanghai (CN)

(73) Assignee: SHANGHAI HUALI INTEGRATED CIRCUIT CORPORATION, Shanghai (CN)

( * ) Notice: Subject to any disclaimer, the term of this patent is extended or adjusted under 35 U.S.C. 154(b) by 0 days.

(21) Appl. No.: 17/867,244

(22) Filed: Jul. 18, 2022

(65) Prior Publication Data

US 2023/0115769 A1 Apr. 13, 2023

(30) Foreign Application Priority Data

Sep. 28, 2021 (CN) ..... 202111139875.6

(51) Int. Cl.
*G05F 1/59* (2006.01)

(52) U.S. Cl.
CPC ..... *G05F 1/59* (2013.01)

(58) Field of Classification Search
CPC ..... G05F 1/59
See application file for complete search history.

(56) References Cited

U.S. PATENT DOCUMENTS

2015/0214903 A1* 7/2015 Zhang ..... H03F 3/345 330/291
2016/0252919 A1* 9/2016 Tanaka ..... G05F 1/56 323/280
2021/0124380 A1* 4/2021 Fort ..... G05F 1/445
2023/0094422 A1* 3/2023 Yin ..... H03K 17/302 323/282
2023/0208291 A1* 6/2023 Ruck ..... H02M 3/157 363/13

* cited by examiner

*Primary Examiner* — Jue Zhang
*Assistant Examiner* — Lakaisha Jackson
(74) *Attorney, Agent, or Firm* — Alston & Bird LLP

(57) ABSTRACT

The present application provides a distributed LDO regulator structure without an external capacitor. The structure includes one CORE module; and one or more POWER modules driven by one of the CORE modules. The CORE module comprises a mirror source voltage generating circuit and a built-in LDO regulator circuit. An output end of an operational amplifier and a gate of the sixth PMOS together serve as a control voltage end of the POWER module. A negative input end of the operational amplifier is connected to a drain of the fifth PMOS and a source of the sixth PMOS by means of a first resistor, wherein a connection end serves as an output end of the built-in LDO regulator circuit. POWER modules having the same output voltage are connected to each other in parallel.

8 Claims, 1 Drawing Sheet

DISTRIBUTED LDO STRUCTURE WITHOUT EXTERNAL CAPACITOR

CROSS-REFERENCES TO RELATED APPLICATIONS

This application claims the priority to Chinese patent application No. CN202111139875.6, filed on Sep. 28, 2021 at CNIPA, and entitled "DISTRIBUTED LDO STRUCTURE WITHOUT EXTERNAL CAPACITOR", the disclosure of which is incorporated herein by reference in entirety.

TECHNICAL FIELD

The present application relates to the technical field of semiconductors, in particular, to a distributed LDO regulator structure without an external capacitor.

BACKGROUND

A low-dropout (LDO) regulator is a DC linear voltage regulator that can regulate the output voltage even when the supply voltage is very close to the output voltage. Currently, a plurality of LDOs are usually integrated into a large-scale system-on-chip (SOC) as power supplies, achieving main functions of power supply separation and crosstalk prevention. There are two kinds of conventional LDOs, when each LDO regulator is an independent loop system. Therefore, different load requirements for conventional LDO regulator designs may lead to completely different LDO regulator operational amplifier structures and compensation structures. However, one of the LDO regulator requires a micro-Farad (uF) level capacitor at the output end thereof, and the other LDOs do not require an external capacitor. For the SOC, designing LDOs according to different load conditions necessarily leads to a significant resource waste and low efficiency. Moreover, for the conventional LDO regulator structure, in consideration of loop stability, the output ends of different LDOs cannot be connected together, resulting in inconvenience in use.

BRIEF SUMMARY

In view of the above defects, the present application provides a distributed LDO regulator structure without an external capacitor, so as to solve the problems of resource waste and low efficiency caused by designing conventional LDOs according to different load conditions and inconvenience in use resulting from the impossibility of connecting output ends of different LDOs together.

The present application provides a distributed LDO regulator structure without an external capacitor, including: one CORE module and one or more POWER modules driven by the CORE module.

The CORE module includes a mirror source voltage generating circuit and a built-in LDO regulator circuit.

The mirror source voltage generating circuit includes: first to fourth NMOSs, and first, second, and fourth PMOSs; a gate and a drain of the first NMOS and a gate of the second NMOS being all connected to a current input end IREF; a drain of the second NMOS, a drain and a gate of the first PMOS, and a gate of the second PMOS being connected to each other; a source of the fourth NMOS being connected to a gate of the third NMOS.

The built-in LDO regulator circuit includes: an operational amplifier, third, fifth, and sixth PMOSs, and a fifth NMOS.

An output end of the operational amplifier and a gate of the sixth PMOS together serve as a control voltage end VOBIAS of the POWER module; respective sources of the fifth PMOS, the third PMOS, the fourth PMOS, the second PMOS, and the first PMOS being connected to each other.

A gate of the fifth PMOS, a drain of the third PMOS, and a drain of the fifth NMOS are connected to each other.

A gate of the third PMOS, a drain of the fourth PMOS, and a drain of the fourth NMOS being connected to each other, with a connection end serve as a voltage bias end PBIAS.

A gate of the fifth NMOS, a gate of the fourth NMOS, a drain of the third NMOS, and a drain of the second PMOS are connected to each other, with a connection end serving as a voltage bias end NBIAS.

A negative input end of the operational amplifier are connected to a drain of the fifth PMOS and a source of the sixth PMOS by means of a first resistor, with a connection end serving as an output end of the built-in LDO regulator circuit.

The POWER module includes: a sixth NMOS, a seventh PMOS, an eighth PMOS, and a ninth PMOS; a drain of the seventh PMOS, a gate of the eighth PMOS, and a drain of the sixth NMOS being connected to each other; a source of the seventh PMOS and a source of the eighth PMOS being connected to each other; a drain of the eighth PMOS and a source of the ninth PMOS being connected to each other, with a connection end serving as an output end VOUT of the POWER module; a source of the sixth MOS and a drain of the ninth MOS being connected to each other.

A gate of the seventh PMOS being connected to the voltage bias end PBIAS; a gate of the sixth NMOS being connected to the voltage bias end NBIAS; and a gate of the ninth PMOS being connected to the control voltage end VOBIAS.

In an example, the built-in LDO regulator circuit further includes second and third resistors; the mirror source voltage generating circuit further includes a fourth resistor; one end of the second resistor is connected to the negative input end of the operational amplifier; one end of the third resistor is connected to a drain of the sixth PMOS and a source of the fifth NMOS; one end of the fourth resistor is connected to the gate of the third NMOS; and the other end of the second resistor, the other end of the third resistor, the other end of the fourth resistor, a source of the third NMOS, a source of the second NMOS, and a source of the first NMOS are all grounded.

In an example, the POWER module further includes a fifth resistor; one end of the fifth resistor is connected to a source of the sixth NMOS, and the other end of the fifth resistor is grounded.

In an example, the drain of the first NMOS serves as the current input end IREF for generating a mirror source voltage; and the output end of the built-in LDO regulator circuit outputs the mirror source voltage VFB.

In an example, a voltage output from the output end VOUT of the POWER module is a mirror of the mirror source voltage VFB; the fifth PMOS serves as a mirror source of the eighth PMOS; and the sixth PMOS and the fifth NMOS are mirror sources of the ninth PMOS and the sixth NMOS.

In an example, the eighth PMOS provides driving power; the ninth PMOS serves as an FVF transistor, and the control voltage end VOBIAS to which the gate of the ninth PMOS is connected determines a voltage of the output end VOUT of the POWER module.

In an example, the seventh PMOS and the sixth NMOS form a driving stage of the eighth PMOS, the sixth NMOS functions as a common gate amplifier, and the sixth NMOS provides a gain for the POWER module.

In an example, when more than one POWER modules of the plurality of POWER modules driven by the CORE module have a same output voltage, the more than one POWER modules are connected to each other in parallel.

As stated above, the distributed LDO regulator structure without an external capacitor as in the preset application has the following beneficial effects: by the present application, an LDO regulator having any drive capability can be formed by the POWER modules. Outputs of these POWER modules are completely isolated from each other, and crosstalk isolation between channels can reach the level of conventional discrete LDOs, thus satisfying the requirements of a SOC for power isolation. These POWER modules can also be used in parallel so as to achieve a greater drive capability. Moreover, the discrete POWER modules can be arranged according to actual design requirements, so as to optimize the parasitic effect of power supply wiring and reduce a voltage drop loss caused by the wiring.

DETAILED DESCRIPTION OF THE DISCLOSURE

The embodiments of the present application are described below using specific examples, and those skilled in the art can easily understand other advantages and effects of the present application from the contents disclosed in the Description. The present application can also be implemented or applied using other different specific embodiments, and various details in the Description can also be modified or changed based on different viewpoints and applications without departing from the spirit of the present application.

Figure 1:
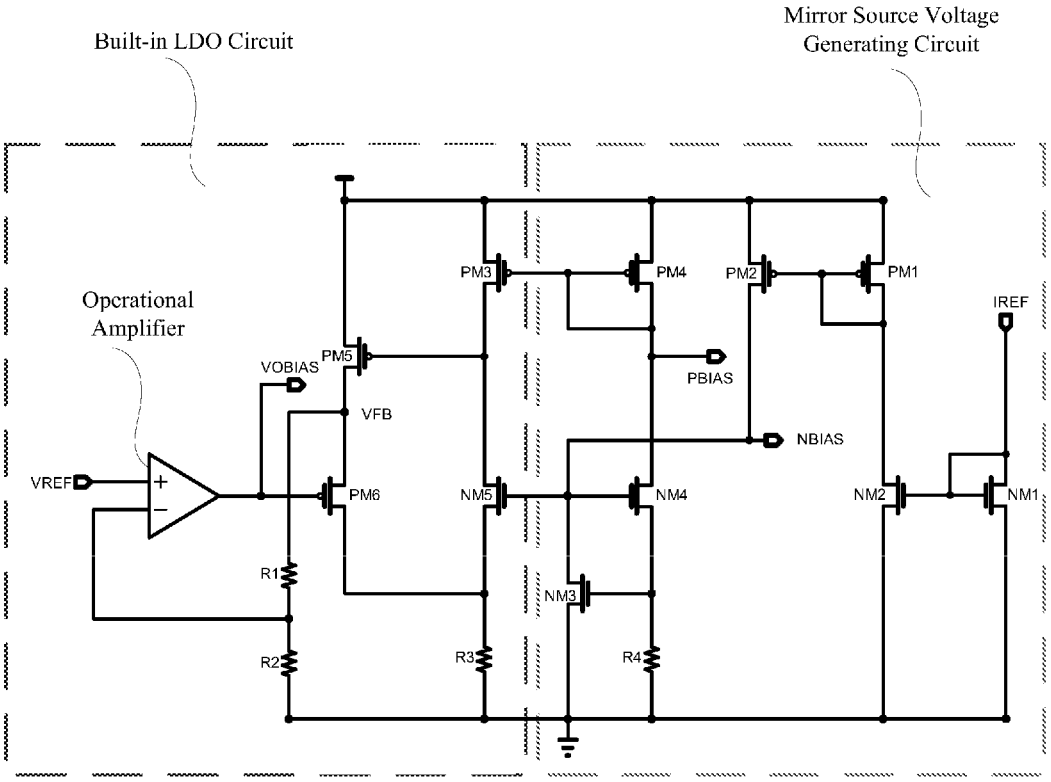
FIG. 1 is a schematic circuit diagram of a CORE module according to the present application.
Figure 2:
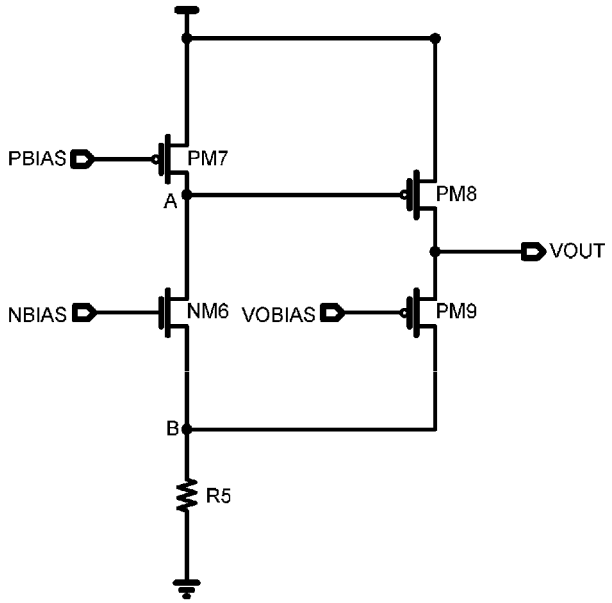
FIG. 2 is a schematic circuit diagram of a POWER module according to the present application.

Please refer to FIGS. 1-2. It should be noted that the drawings provided in this embodiment are only used to illustrate the basic concept of the present application in a schematic way, so the drawings only show the components related to the present application rather than being drawn according to the number, shape and size of the components in actual implementation. The type, number and proportion of various components can be changed randomly during actual implementation, and the layout of components may be more complicated.

The present application provides a distributed LDO regulator structure without an external capacitor, at least including the following:

at least one CORE module; and one or more POWER modules driven by one of the CORE modules.

Referring to FIG. 1, FIG. 1 is a schematic circuit diagram of a CORE module according to the present application.

The CORE module includes a mirror source voltage generating circuit and a built-in LDO regulator circuit.

The mirror source voltage generating circuit includes: first to fourth NMOSs, i.e., the first NMOS (NM1), the second NMOS (NM2), the third NMOS (NM3), and the fourth NMOS (NM4); and first, second, and fourth PMOSs, i.e., the first PMOS (PM1), the second PMOS (PM2), and the fourth PMOS (PM4). A gate and a drain of the first NMOS and a gate of the second NMOS are all connected to a current input end IREF. A drain of the second NMOS, a drain and a gate of the first PMOS, and a gate of the second PMOS are connected to each other. A source of the fourth NMOS is connected to a gate of the third NMOS.

The built-in LDO regulator circuit includes: an operational amplifier, third, fifth, and sixth PMOSs, and a fifth NMOS. That is, the built-in LDO regulator circuit includes: the operational amplifier, the third PMOS (PM3), the fifth PMOS (PM5), the sixth PMOS (PM6), and the fifth NMOS (NM5);

An output end of the operational amplifier and a gate of the sixth PMOS together serve as a control voltage end VOBIAS of the POWER module. Respective sources of the fifth PMOS, the third PMOS, the fourth PMOS, the second PMOS, and the first PMOS are connected to each other.

A gate of the fifth PMOS, a drain of the third PMOS, and a drain of the fifth NMOS are connected to each other.

A gate of the third PMOS, a drain of the fourth PMOS, and a drain of the fourth NMOS are connected to each other, with a connection end serving as a voltage bias end PBIAS.

A gate of the fifth NMOS, a gate of the fourth NMOS, a drain of the third NMOS, and a drain of the second PMOS are connected to each other, with a connection end serving as a voltage bias end NBIAS.

A negative input end of the operational amplifier is connected to a drain of the fifth PMOS and a source of the sixth PMOS by means of a first resistor, with a connection end serving as an output end of the built-in LDO regulator circuit.

Referring to FIG. 2, FIG. 2 is a schematic circuit diagram of a POWER module according to the present application.

The POWER module includes: a sixth NMOS, a seventh PMOS, an eighth PMOS, and a ninth PMOS. That is, the POWER module includes: the sixth NMOS (NM6), the seventh PMOS (PM7), THE eighth PMOS (PM8), and the ninth PMOS (PM9).

A drain of the seventh PMOS, a gate of the eighth PMOS, and a drain of the sixth NMOS are connected to each other. A source of the seventh PMOS and a source of the eighth PMOS are connected to each other. A drain of the eighth PMOS and a source of the ninth PMOS are connected to each other, with a connection end serving as an output end VOUT of the POWER module. A source of the sixth MOS and a drain of the ninth MOS are connected to each other.

A gate of the seventh PMOS is connected to the voltage bias end PBIAS. A gate of the sixth NMOS is connected to the voltage bias end NBIAS. A gate of the ninth PMOS is connected to the control voltage end VOBIAS.

In this embodiment of the present application, the built-in LDO regulator circuit further includes a second resistor (R2) and a third resistor (R3); and the mirror source voltage generating circuit further includes a fourth resistor (R4). One end of the second resistor is connected to the negative input end of the operational amplifier. One end of the third resistor is connected to a drain of the sixth PMOS and a source of the fifth NMOS. One end of the fourth resistor is connected to the gate of the third NMOS. The other end of the second resistor, the other end of the third resistor, the other end of the fourth resistor, a source of the third NMOS, a source of the second NMOS, and a source of the first NMOS are all grounded.

In this embodiment of the present application, the POWER module further includes a fifth resistor (R5). One end of the fifth resistor is connected to a source of the sixth NMOS, and the other end of the fifth resistor is grounded.

In this embodiment of the present application, the drain of the first NMOS serves as the current input end IREF for generating a mirror source voltage; and the output end of the built-in LDO regulator circuit outputs the mirror source voltage VFB.

In this embodiment of the present application, a voltage output from the output end VOUT of the POWER module is a mirror of the mirror source voltage VFB; the fifth PMOS serves as a mirror source of the eighth PMOS; and the sixth PMOS and the fifth NMOS are mirror sources of the ninth PMOS and the sixth NMOS.

In this embodiment of the present application, the eighth PMOS (PM8) provides driving power; the ninth PMOS (PM9) serves as a flipped voltage follower (FVF) transistor, and the control voltage end VOBIAS to which the gate of the ninth PMOS is connected determines a voltage of the output end VOUT of the POWER module.

In this embodiment of the present application, the seventh PMOS and the sixth NMOS form a driving stage of the eighth PMOS, the sixth NMOS functions as a common gate amplifier, and the sixth NMOS provides a gain for the POWER module.

In this embodiment of the present application, when one of the CORE modules drives a plurality of POWER modules, the POWER modules having the same output voltage in the plurality of POWER modules are connected to each other in parallel.

A distributed LDO regulator structure without an external capacitor of the present application includes a CORE module and a POWER module. The CORE module provides a bias signal that determines an output voltage of the distributed LDO regulator without an external capacitor, and the main idea comes from the extension of a conventional Capless LDO. The POWER module generates an output voltage having a drive capability under the control of the CORE module. The innovation of the distributed LDO regulator structure without an external capacitor lies in that one CORE module can control any number of POWER modules. In other embodiments, one CORE module can control three 10 mA POWER modules, one 20 mA POWER module, one 50 mA POWER module, and one 100 mA POWER module, so as to achieve the objective of achieving a plurality of power outputs. In addition, the 50 mA POWER module and the 10 mA POWER module can be connected in parallel to achieve the objective of achieving an LDO regulator having 60 mA drive capability. Therefore, in the present application, an LDO regulator having any drive capability can be formed by these basic POWER modules. Outputs of these POWER modules are completely isolated from each other, and crosstalk isolation between channels can reach the level of conventional discrete LDOs, thus satisfying the requirements of a SOC for power isolation. These POWER modules can also be used in parallel so as to achieve a greater drive capability. Moreover, the discrete POWER modules can be arranged according to actual design requirements, so as to optimize the parasitic effect of power supply wiring and reduce a voltage drop loss caused by the wiring.

A bias voltage defined by the CORE module of the present application is mirrored to each POWER module, so as to achieve the objective of mirroring the voltage of the output end VOUT. An output of the built-in LDO regulator circuit of the present application is completely consistent with an output of the POWER module, so that the CORE module forms a built-in LDO regulator circuit having a fixed drive capability, and the mirror source voltage VFB is the output of the built-in LDO regulator circuit. The mirror source voltage generating circuit is provided with a bias of a mirror circuit by a current input from the current input end IREF, so as to obtain a stable operating point, thereby generating the mirror source voltage VFB. The voltage output from the output end VOUT of the POWER module is the mirror of VFB. An output of the operational amplifier serves as the control voltage (VOBIAS) of the FVF transistor of the POWER module, and PBIAS and NBIAS are generated by PM3, PM4, NM3, NM4, NMS, and R4. PM5 is a mirror source of PM8 in the POWER module, and PM6 and NM5 are mirror sources of PM9 and NM6 in the POWER module. In a typical SOC, a single power supply can be implemented using one CORE module and a plurality of POWER modules. If a plurality of power domains are required, a plurality of CORE modules and corresponding POWER modules are required.

The POWER module (FIG. 2) adopts a flipped voltage follower (FVF) structure, which consists of three PMOS transistors, one NMOS transistor, and one resistor. PM8 is an output POWER MOS which provides an output drive capability. PM9 is an FVF transistor with the control end VOBIAS thereof directly determining the VOUT voltage. PM7 and NM6 form a driving stage of PM8, and NM6 functions as a common gate amplifier, providing a gain for a feedback loop of the POWER module.

In this module, the bias voltages PBIAS, NBIAS, and VOBIAS of the three input voltage bias ends are mirrored by the internal LDO regulator circuit of the CORE module, and the three voltages are not affected by load changes. When VOUT is reduced due to the effect of a load, because VOBIAS does not change, VGS (voltage between gate and source ends) of PM9 is reduced, a current passing through PM9 is reduced, and a voltage at point B is reduced. In this case, since NBIAS does not change, a voltage at point A is reduced, causing VGS of PM8 to increase, thereby providing additional drive to pull up VOUT, and vice versa. Such the self-adjusting feature enables the POWER module to not interfere with other POWER modules connected to NBIAS, PBIAS, and VOBIAS and to not interfered by other POWER modules, thereby achieving good channel isolation.

To sum up, in present application, an LDO regulator having any drive capability can be formed by the POWER modules. Outputs of these POWER modules are completely isolated from each other, and crosstalk isolation between channels can reach the level of conventional discrete LDOs, thus satisfying the requirements of a SOC for power isolation. These power modules can also be used in parallel so as to achieve a greater drive capability.

Moreover, the discrete power modules can be arranged according to actual design requirements, so as to optimize the parasitic effect of power supply wiring and reduce a voltage drop loss caused by the wiring. Therefore, the present application effectively overcomes various defects in the prior art and has high industrial utilization value.

The above embodiment merely illustrates the principle and effect of the present application, rather than limiting the present application. Anyone skilled in the art can modify or change the above embodiment without departing from the spirit and scope of the present application. Therefore, all equivalent modifications or changes made by those with ordinary knowledge in the art without departing from the spirit and technical idea disclosed in the present application shall still be covered by the claims of the present application.

What is claimed is:

1. A distributed LDO regulator structure without an external capacitor, at least comprising:

one CORE module; and a plurality of POWER modules driven by the CORE module;

wherein the CORE module comprises a mirror source voltage generating circuit and a built-in LDO regulator circuit;

wherein the mirror source voltage generating circuit comprises:

a first, a second, a third and a fourth NMOSs; and a first, a second, and a fourth PMOSs;

wherein a gate and a drain of the first NMOS and a gate of the second NMOS are all connected to a current input end IREF;

wherein a drain of the second NMOS, a drain and a gate of the first PMOS, and a gate of the second PMOS are connected to each other; and wherein a source of the fourth NMOS is connected to a gate of the third NMOS;

wherein the built-in LDO regulator circuit comprises:

an operational amplifier;

a third, a fifth, and a sixth PMOSs; and a fifth NMOS;

wherein an output end of the operational amplifier and a gate of the sixth PMOS together serve as a control voltage end VOBIAS of one of the plurality of POWER modules; wherein respective sources of the fifth PMOS, the third PMOS, the fourth PMOS, the second PMOS, and the first PMOS are connected to each other; wherein a gate of the fifth PMOS, a drain of the third PMOS, and a drain of the fifth NMOS are connected to each other;

wherein a gate of the third PMOS, a drain of the fourth PMOS, and a drain of the fourth NMOS are connected to each other, with a connection end serving as a voltage bias end PBIAS;

wherein a gate of the fifth NMOS, a gate of the fourth NMOS, a drain of the third NMOS, and a drain of the second PMOS are connected to each other, with a connection end serving as a voltage bias end NBIAS; wherein a negative input end of the operational amplifier is connected to a drain of the fifth PMOS and a source of the sixth PMOS by means of a first resistor, with a connection end serving as an output end of the built-in LDO regulator circuit;

wherein said module of the plurality of POWER modules comprises:

a sixth NMOS, a seventh PMOS, an eighth PMOS, and a ninth PMOS;

wherein a drain of the seventh PMOS, a gate of the eighth PMOS, and a drain of the sixth NMOS are connected to each other;

wherein a source of the seventh PMOS and a source of the eighth PMOS are connected to each other;

wherein a drain of the eighth PMOS and a source of the ninth PMOS are connected to each other, with a connection end serving as an output end VOUT of said module of the plurality of POWER modules;

wherein a source of the sixth MOS and a drain of the ninth MOS are connected to each other;

wherein a gate of the seventh PMOS is connected to the voltage bias end PBIAS;

wherein a gate of the sixth NMOS is connected to the voltage bias end NBIAS; and wherein a gate of the ninth PMOS is connected to the control voltage end VOBIAS.

2. The distributed LDO regulator structure without the external capacitor according to claim 1, wherein the built-in LDO regulator circuit further comprises a second and a third resistors;

wherein the mirror source voltage generating circuit further comprises a fourth resistor;

wherein one end of the second resistor is connected to the negative input end of the operational amplifier; wherein one end of the third resistor is connected to a drain of the sixth PMOS and a source of the fifth NMOS;

wherein one end of the fourth resistor is connected to the gate of the third NMOS; and wherein one other end of the second resistor, one other end of the third resistor, one other end of the fourth resistor, a source of the third NMOS, a source of the second NMOS, and a source of the first NMOS are all grounded.

3. The distributed LDO regulator structure without the external capacitor according to claim 2, wherein said module of the plurality of POWER modules further comprises a fifth resistor;

wherein one end of the fifth resistor is connected to a source of the sixth NMOS, and one other end of the fifth resistor is grounded.

4. The distributed LDO regulator structure without the external capacitor according to claim 1, wherein the drain of the first NMOS serves as the current input end IREF for generating a mirror source voltage; and wherein the output end of the built-in LDO regulator circuit outputs the mirror source voltage VFB.

5. The distributed LDO regulator structure without the external capacitor according to claim 1, wherein a voltage output from the output end VOUT of said module of the plurality of POWER modules is a mirror of the mirror source voltage VFB; wherein the fifth PMOS serves as a mirror source of the eighth PMOS; and the sixth PMOS and the fifth NMOS are mirror sources of the ninth PMOS and the sixth NMOS.

6. The distributed LDO regulator structure without the external capacitor according to claim 1, wherein the eighth PMOS provides a driving power; wherein the ninth PMOS serves as an FVF transistor, and wherein the control voltage end VOBIAS, which the gate of the ninth PMOS is connected to, determines a voltage of the output end VOUT of said module of the plurality of POWER modules.

7. The distributed LDO regulator structure without the external capacitor according to claim 1, wherein the seventh PMOS and the sixth NMOS form a driving stage of the eighth PMOS, the sixth NMOS functions as a common gate amplifier, and the sixth NMOS provides a gain for the POWER module.

8. The distributed LDO structure without the external capacitor according to claim 1, wherein when more than one POWER modules of the plurality of POWER modules driven by the CORE module have a same output voltage, the more than one POWER modules are connected to each other in parallel.

* * * * *